US010830253B2

(12) United States Patent
Hermes et al.

(10) Patent No.: US 10,830,253 B2
(45) Date of Patent: Nov. 10, 2020

(54) ROTOR, AXIAL COMPRESSOR, INSTALLATION METHOD

(71) Applicant: Siemens Aktiengesellschaft, Munich (DE)

(72) Inventors: Viktor Hermes, Duisburg (DE); Rosario Montante, Wuppertal (DE); Erich Muranyi, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 175 days.

(21) Appl. No.: 15/531,454

(22) PCT Filed: Nov. 3, 2015

(86) PCT No.: PCT/EP2015/075575
§ 371 (c)(1),
(2) Date: May 29, 2017

(87) PCT Pub. No.: WO2016/087153
PCT Pub. Date: Jun. 9, 2016

(65) Prior Publication Data

US 2017/0268536 A1 Sep. 21, 2017

(30) Foreign Application Priority Data

Dec. 4, 2014 (DE) ..... 10 2014 224 844

(51) Int. Cl.
*F04D 29/64* (2006.01)
*F01D 5/30* (2006.01)
(Continued)

(52) U.S. Cl.
CPC ..... *F04D 29/644* (2013.01); *F01D 5/022* (2013.01); *F01D 5/06* (2013.01); *F01D 5/3007* (2013.01);
(Continued)

(58) Field of Classification Search
CPC ..... F04D 29/32; F04D 29/34; F04D 29/324; F04D 29/322; F04D 29/053;
(Continued)

(56) References Cited

U.S. PATENT DOCUMENTS 2,656,147 A 10/1953 Brownhill et al.
2,671,634 A 3/1954 Morley
(Continued)

FOREIGN PATENT DOCUMENTS

DE 2620762 B1 4/1977
DE 69525014 T2 8/2002
(Continued)

OTHER PUBLICATIONS

DE Search Report dated Sep. 17, 2015, for DE patent application No. 102014224844.2.
(Continued)

*Primary Examiner* — Kenneth J Hansen
(74) *Attorney, Agent, or Firm* — Wolter Vandyke Davis, PLLC

(57) ABSTRACT

A rotor of a multi-staged axial compressor which extends along an axis of rotation. The rotor has a shaft which has rotor blade slots. Rotor blades of the rotor are arranged next to one another in the circumferential direction and are each secured to the rotor blade slots by a blade root to form a respective rotor blade stage. At least two rotor blade stages are provided in axial succession and an interspace slot, extending in the circumferential direction, is provided in the shaft axially between the two rotor blade stages. The rotor blade slots open into the interspace slots and blade roots of the rotor blades are insertable radially into the interspace slots and can be pushed into the rotor blade slots. The rotor has an interspace cover which covers the interspace slots,
(Continued)

wherein the interspace cover is designed segmented into interspace cover segments in the circumferential direction.

8 Claims, 2 Drawing Sheets

(51) Int. Cl.

| | |
|---|---|
| ***F01D 5/02*** | (2006.01) |
| ***F01D 5/32*** | (2006.01) |
| ***F01D 5/06*** | (2006.01) |
| ***F04D 29/053*** | (2006.01) |
| ***F04D 29/32*** | (2006.01) |

(52) U.S. Cl.
CPC ..... *F01D 5/3015* (2013.01); *F01D 5/323* (2013.01); *F04D 29/053* (2013.01); *F04D 29/322* (2013.01)

(58) Field of Classification Search
CPC ..... F04D 29/542; F04D 29/644; F01D 5/323; F01D 5/3015; F01D 5/3007; F01D 5/06; F01D 5/022; F01D 5/02; F01D 5/3023; F01D 5/303; F01D 5/3038; F01D 5/3046
USPC ..... 416/215, 220 R
See application file for complete search history.

(56) References Cited

U.S. PATENT DOCUMENTS

| | | | | |
|---|---|---|---|---|
| 3,603,702 | A * | 9/1971 | Jensen | F01D 5/3007 415/201 |
| 4,127,359 | A | 11/1978 | Stephan | |
| 4,432,697 | A | 2/1984 | Miura et al. | |
| 5,611,669 | A | 3/1997 | Royle | |
| 8,858,181 | B2 | 10/2014 | Cloarec | |
| 2004/0037703 | A1 | 2/2004 | Arinci et al. | |
| 2011/0255977 | A1 | 10/2011 | Pruthi et al. | |
| 2014/0037396 | A1 | 2/2014 | Jette et al. | |
| 2014/0069101 | A1 * | 3/2014 | Race | F04D 29/522 60/726 |

FOREIGN PATENT DOCUMENTS

| | | | |
|---|---|---|---|
| GB | 2312254 | A | 10/1997 |
| KR | 20030053437 | A | 6/2003 |
| RU | 2011113993 | A | 10/2012 |

OTHER PUBLICATIONS

International Search Report dated Apr. 6, 2016, for PCT/EP2015/075575.
IPPR (PCT/IPEA 416 and 409) dated Nov. 10, 2016, for PCT/EP2015/075575.
RU search report dated Jul. 13, 2018, for corresponding RU patent application No. 2017123340/06.

* cited by examiner

ROTOR, AXIAL COMPRESSOR, INSTALLATION METHOD

CROSS REFERENCE TO RELATED APPLICATIONS

This application is the US National Stage of International Application No. PCT/EP2015/075575 filed Nov. 3, 2015, and claims the benefit thereof. The International Application claims the benefit of German Application No. DE 102014224844.2 filed Dec. 4, 2014. All of the applications are incorporated by reference herein in their entirety.

FIELD OF INVENTION

The invention relates to a rotor of a multi-stage axial compressor, which extends along an axis of rotation, wherein the rotor has a shaft, wherein the shaft has rotor blade grooves, wherein rotor blades of the rotor which are arranged next to one another in the circumferential direction and are each fastened to the rotor blade grooves by means of a blade root form a respective rotor blade stage, wherein at least two rotor blade stages are provided in axial succession, and an interspace groove, extending in the circumferential direction, is provided in the shaft axially between the two rotor blade stages, wherein the rotor blade grooves open into the inter-space grooves and this arrangement is designed in such a manner that blade roots of the rotor blades can be inserted radially into the interspace grooves and can be pushed from there into the rotor blade grooves, wherein the rotor has an interspace cover which covers the interspace grooves, wherein the interspace cover is designed segmented into interspace cover segments in the circumferential direction, wherein the inter-space cover segments are fastened in a form-fitting manner to the shaft.

Furthermore, the invention also relates to an axial compressor and to a method for installing the axial compressor with the above rotor.

BACKGROUND OF INVENTION

The most frequent fastening of blades to a solid shaft of an axial compressor makes provision for a groove extending in the circumferential direction to be provided with undercuts on the shaft, and for the rotating rotor blades to be inserted in a certain circumferential position radially into said circumferential groove at an insertion point by a corresponding root, which is likewise formed with an undercut, at a certain circumferential position, and subsequently to be displaced onto the circumferential end position provided for the completely mounted shaft or for the completely mounted rotor. The roots of the rotor blades are generally designed in this case as a hammerhead root, and the connection of the shaft to the blades is form-fitting.

The hammerhead root connection is already known from U.S. Pat. No. 8,858,181 B2.

A connection which is subject to less loading can also take place on the shaft by means of blade roots which are not formed with an undercut, for example by means of plug-in bolts which, inserted in the axial direction, connect a shaft shoulder in a form-fitting manner to a blade root drilled in the axial direction.

A design of this type is known, for example, from U.S. Pat. No. 2,671,634.

It is already known from DE69525014T2 to provide solid rotors of turbomachines with groove covers, which extend in the circumferential direction, between the rotor blade stages.

A guide vane stage is generally provided axially between the two rotor blade stages of a compressor of the above type, said guide vane stage correspondingly aligning the process fluid flowing through the axial compressor for entry into the rotor blade stage positioned downstream. The advantage of a rotor blade fastened in a circumferential groove extending in the circumferential direction resides in the low outlay on manufacturing since the circumferential groove can be produced by straightforward turning. The root geometry as a hammerhead which is regularly provided for the form-fitting fastening in axial compressors subjected to higher loads has such an effect in conjunction with the circumferential groove in the shaft and the alignment of the blades on the rotor that only a limited contact surface between the shaft material and the blade root material is available for transmitting forces from the blade to the shaft. In particular, each individual rotor blade has available only a small circumferential segment over the circumference, corresponding to the number of rotor blades of a stage, for transmitting the force by means of the undercut of the root to the undercut in the circumferential groove. This is because, in the geometry of the hammerhead root, the width in the circumferential direction of the contact surfaces of the undercut cannot go beyond the width of the circumferential segment. Accordingly, the geometry of the circumferential groove with the hammerhead root that is available for transmitting force acts in a restricting manner on the rotational speed and the diameter of the rotor at a certain mass of the rotor blade. If the specific forces are too high, it is known no longer to fasten the rotor blades to the shaft in a form-fitting manner by means of a circumferential groove, but rather by means of a separate fastening groove, running substantially axially and tangentially, for each individual rotor blade on the shaft. Said fastening groove in the shaft for the rotor blades can be formed here rectilinearly or curved with a constant radius. The rotor blades are pushed into said fastening grooves with a rotor blade root provided with undercuts, wherein a direction of movement of the push-in movement is provided with at least one axial component. The push-in direction generally runs obliquely with respect to an axis of rotation of the rotor at an angle which is particularly advantageous for aligning the blade and the blade root mechanically. The fastening grooves for such a rotor blade fastening are not incorporated into the shaft by means of a turning process, but rather are milled into the shaft or produced in another manner.

In the case of a solid rotor or a shaft which is formed substantially integrally and is not assembled axially from individual disks, to push in rotor blade roots designed in such a manner into corresponding fastening grooves, a groove extending in the circumferential direction is required for the radial insertion of the rotor blade root prior to the pushing thereof into the fastening groove. The fastening groove opens here into the circumferential grooves. Instead of a circumferential groove, a shaft shoulder can also be provided. The separate fastening grooves for each blade are also designed as Christmas tree grooves.

Christmas tree grooves are already known from US 2014/0037396 A1.

SUMMARY OF INVENTION

The circumferential groove is referred to by the invention as an interspace groove and, as the flow passes through the axial compressor, has an aerodynamically loss-increasing effect. The interspace groove is therefore also covered toward the flow duct by means of a guide vane shroud. The guide vane shroud here is fastened as a stationary component consisting of individual segments extending in the circumferential direction to the radially inner points of the guide vanes. The guide vane mesh of the guide vane stage is accordingly bounded radially inwardly by said shroud extending in the circumferential direction, wherein the rotor should essentially not have any radial jump with respect to the radially outer surface of said shroud at the axial transition from the rotor blade stage into the guide vane stage. Since the shroud is a stationary component and a corresponding shaft seal is provided between the shroud and the rotor, corresponding movement gaps should be provided between the shroud and the shaft, said movement gaps having to take into consideration an axial clearance requirement and a radial clearance requirement. Said movement gaps have a loss-increasing action as the flow flows over them through the flow duct. In addition, the solution of covering the circumferential grooves of the rotor between the rotor blade stages by means of shrouds of the guide vanes is complicated because the shrouds and the shaft seals are complex to produce and install.

The invention has an object of providing a rotor of an axial compressor, which rotor avoids the aforementioned disadvantages of the prior art.

To achieve this object according to the invention, a rotor of the type defined at the beginning with the additional features of the characterizing part of the main claim is proposed. In addition, an axial compressor with such a rotor is proposed according to the invention. Furthermore, the invention proposes a method for manufacturing an axial compressor with a rotor according to the invention. The claims, each with a dependency reference, contain advantageous developments of the invention. In addition to the combinations of features of the invention indicated by explicit dependency references and exemplary explanations, the invention also includes combinations of the disclosed features that are expedient to a person skilled in the art but are not explicitly or identically disclosed by said dependency references and exemplary embodiments.

A multi-stage axial compressor within the meaning of the invention is approached axially essentially in the compression stages by a process fluid, and a substantially axial outflow takes place from the final compression stage. The individual compressing stages generally comprise a guide vane stage and a rotor blade stage. The axis of rotation is understood by the invention as meaning the axis about which the rotor of the axial compressor is rotatably formed. All of the details which can be related to an axis, such as axially, radially, circumferential direction, tangentially, refer to this axis-unless stated otherwise. The individual rotor blades of a rotor blade stage of the rotor are fastened to the shaft of the rotor by means of a blade root, wherein the blade root is included in the rotor blade.

An advantageous development of the invention makes provision for each rotor blade stage to be assigned at least one interspace groove, which extends in the circumferential direction, in the shaft. Said interspace groove is covered radially to the outside according to the invention by means of an interspace cover.

Another expedient development of the invention makes provision for an interspace groove to be assigned two adjacent rotor blade stages, and therefore, for the fastening of the rotor blades, the rotor blade stages each have rotor blade grooves which open for both rotor blade stages into the same circumferential groove. In the case of a multi-stage axial compressor with a plurality of rotor blade stages, it is thereby possible to provide an interspace groove for the installation of the rotor blades only in every second interspace between rotor blade stages. It is thereby conceivable that interspaces between rotor blade stages each have an interspace groove and no interspace groove in an alternating sequence. The sequence could be, for example, as follows: rotor blade stage, interspace groove, rotor blade stage, interspace without interspace groove, rotor blade stage, interspace groove, rotor blade stage . . . . It is also conceivable for a mixed form between the possibility of assigning an interspace groove for each rotor blade stage and an interspace groove for precisely two rotor blade stages which are adjacent to be provided. Such a mixed form is expedient in particular in the case of an uneven number of rotor blade stages.

Particularly expedient within the context of a low loss rate of the flow is a cover of the interspace groove by means of the interspace covers in such a manner that a substantially continuously radial transition is produced in the axial direction of the radially outer surface between the rotor blade stage positioned upstream and the interspace cover, and between the interspace cover and the rotor blade stage positioned downstream. At this juncture, the advantages according to the invention come particularly to the fore because no movement gaps have to be provided between the interspace cover and the shaft basic body or the shaft, since the interspace cover forms a fixed connection with the shaft and is attached in a co-rotating manner. In this connection, it is scarcely possible to achieve a transition free from protruding edges in the case of a solution with guide vane shrouds, because of the thermally different expansion extents and expansion directions, in particular of stationary and rotating components.

According to the invention, the shaft is formed as an integral component over at least the axial portion of two rotor blade stages and of an interspace groove. The shaft is particularly designed as an integral, axially nondivided component over the axial compressor. For a rotor constructed from disks, as is customary in the sphere of gas turbines, the use of the invention is not advantageous to the same extent since the disk-type composition of the rotor provides other possibilities of covering the interspace. Therefore, an axially at least partially undivided, in particular solid, integral design of the shaft over a plurality of rotor blade stages is advantageous.

A further advantageous embodiment makes provision for the interspace cover to be arranged and designed in such a manner that the rotor blades are secured by means of the interspace cover against displacement in the rotor blade groove in the axial end position. The interspace cover here not only fulfills the aerodynamic function of guiding the flow, but also the mechanical function of securing rotor blades in the designated axial position on the rotor. It is conceivable here for the blade roots of the rotor blades to lie against the interspace cover or to be able to enter into contact with a clearance with the respective interspace cover. A corresponding axial clearance fit or interference fit may be provided structurally for this purpose. While the rotor blade roots are anchored on the shaft in a form-fitting manner against radial movement, a form-fitting obstruction of an axial movement of the rotor blades is produced by the interspace cover. A design of the rotor blade roots as what are referred to as Christmas tree roots is particularly expedient, and therefore, in comparison to a hammerhead root, a plurality of surfaces of the Christmas tree root lie arranged radially in succession against corresponding contact surfaces of the rotor blade grooves.

An expedient development of the invention makes provision for the interspace cover segments to be fastened in a form-fitting manner to the shaft.

For this purpose, each interspace cover segment is equipped with a hammer root which can be inserted into a corresponding formation, which extends in the circumferential direction, of the interspace groove.

In an expedient development of the invention, at least one interspace lock piece is provided for each interspace groove, in that the interspace groove is arranged at a certain first circumferential position at which the interspace groove is designed differently than over the remaining circumference of the shaft for the purpose of the radial insertion of the interspace cover segments.

In this connection, it is provided according to the invention that the interspace groove at least partially has, extending over the circumference, a first undercut which is formed so as to interact in a form-fitting manner in the radial direction with a second undercut of the interspace cover segment in a manner blocking a movement. It is expedient precisely at this juncture if the interspace lock piece is used to cover the interspace at said circumferential position and at the same time to secure the respective circumferential position of all of the interspace cover segments which are arranged in said interspace groove. The interspace lock piece can be fastened here to the shaft against radial movement by means of a screw connection.

At said first certain circumferential position, the interspace groove advantageously does not have any first undercut. The axial compressor according to the invention makes provision that, radially in relation to the interspace groove and the guide vane stage arranged axially adjacent to at least one rotor blade stage, the guide vanes there are designed as self-supporting guide vanes without a shroud.

In addition to the rotor of the axial compressor, the invention also proposes a method for installing said rotor, which method is usable especially for the formation according to the invention of the rotor.

In this connection, in a first step, a shaft is provided which, in a second step, is fitted with the rotor blades which are to be inserted radially with the blade roots into the interspace grooves and are subsequently fastened by means of pushing the blade roots of the rotor blades into the rotor blade grooves. The axial position of the rotor blade roots or rotor blades on the shaft of the rotor is then secured in a form-fitting manner on the shaft by means of installation of the interspace cover segments.

BRIEF DESCRIPTION OF THE DRAWINGS

The invention is clarified in more detail below on the basis of a specific exemplary embodiment with reference to drawings, in which.

DETAILED DESCRIPTION OF INVENTION

Figure 1:
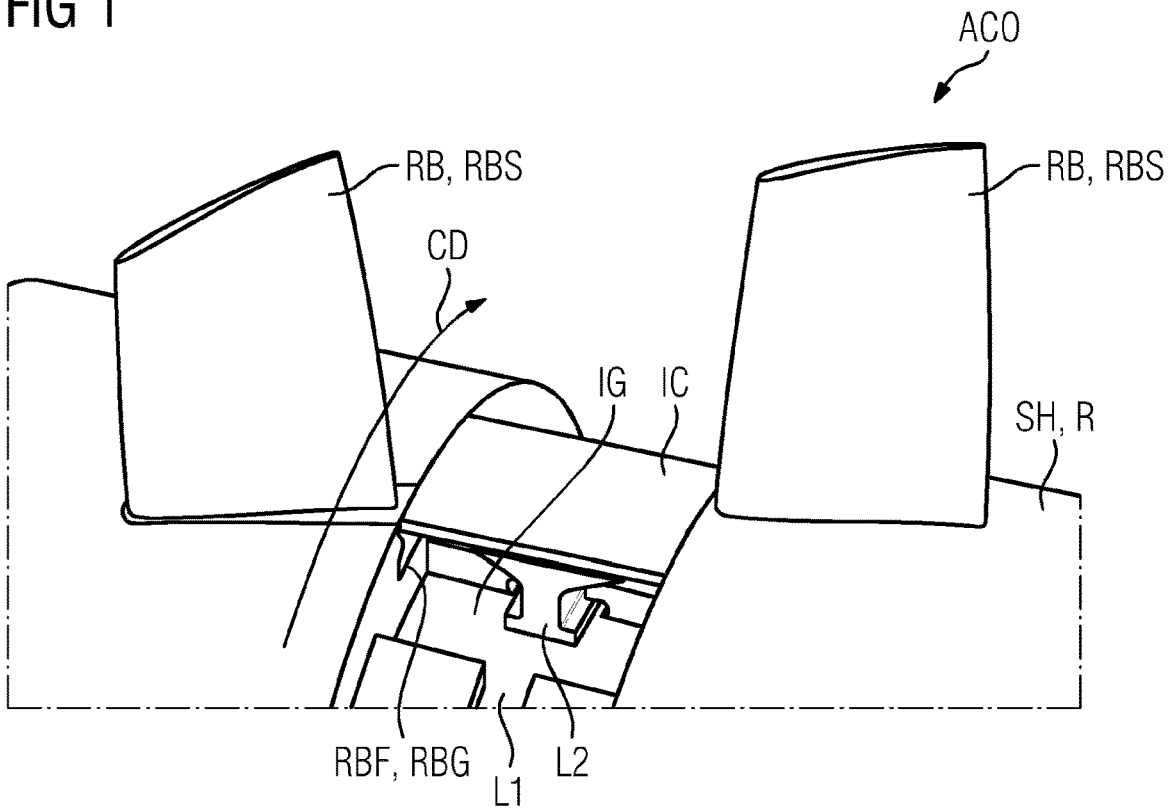
FIG. 1 shows a schematic three-dimensional view of two adjacent rotor blade stages and an interspace groove with an interspace cover.
Figure 2:
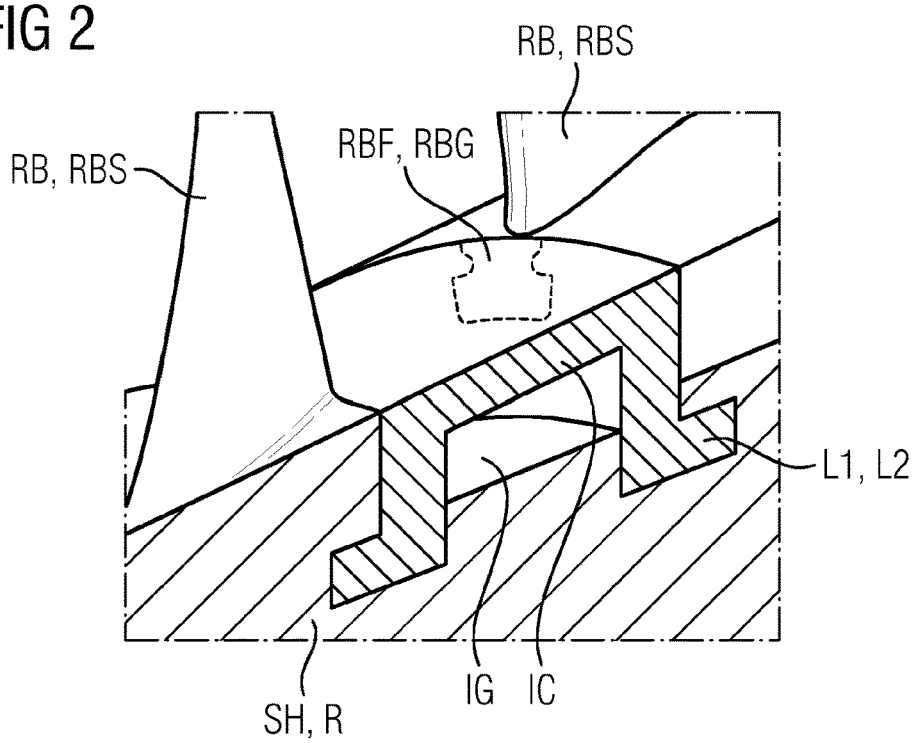
FIG. 2 shows a schematic three-dimensional view of two adjacent rotor blade stages with an interspace groove arranged therebetween and an interspace cover in a further variant embodiment.
Figure 3:
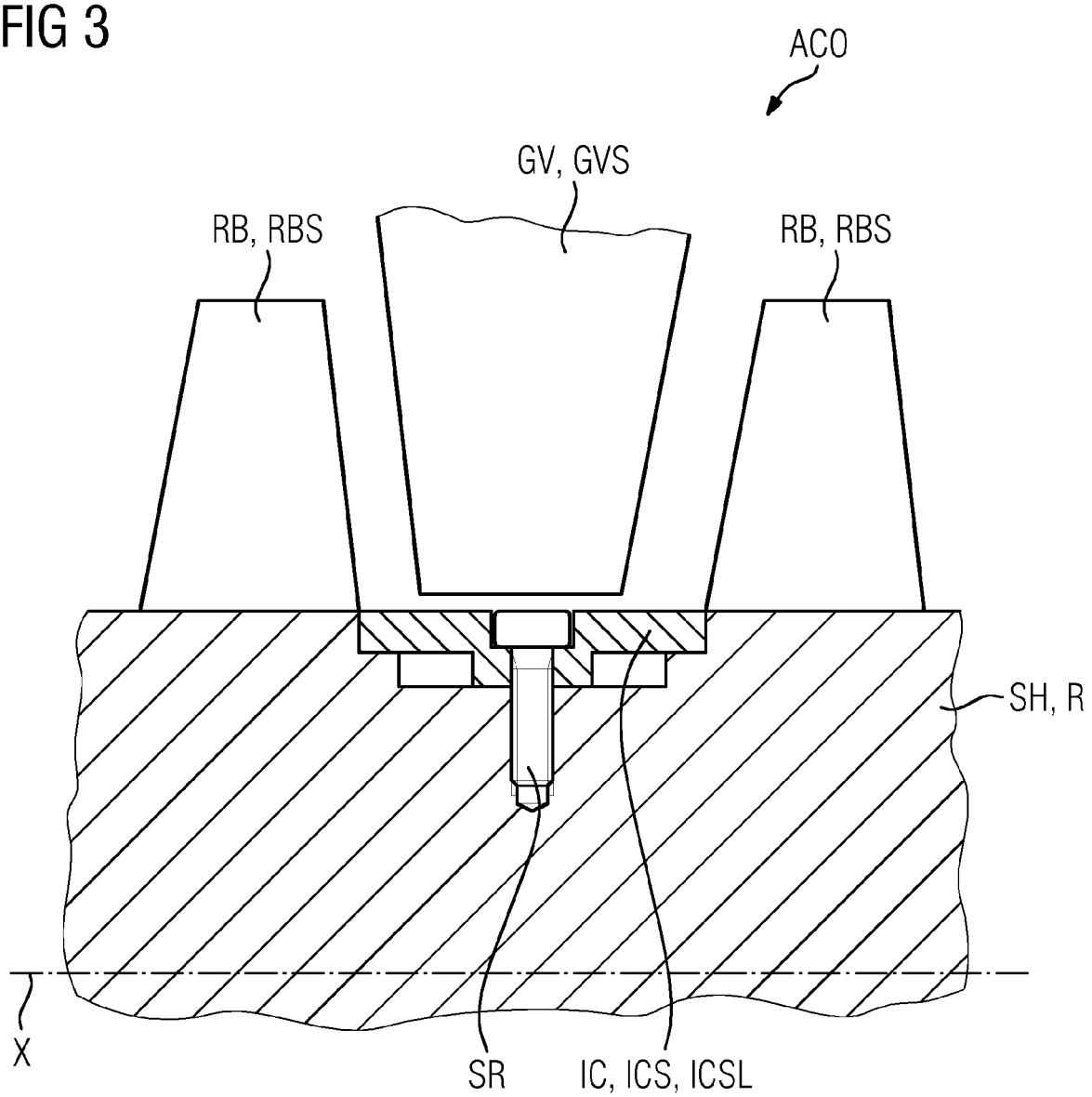
FIG. 3 shows a schematic sectional view of second adjacent rotor blade stages of an axial compressor with a guide vane stage located therebetween in the region of the interspace with an interspace groove and an interspace cover.

FIGS. 1 and 2 each show different variants of the invention with reference to two adjacent rotor blade stages RBS in a schematic three-dimensional view. FIG. 3 shows a schematic longitudinal section through two adjacent rotor blade stages RBS of an axial compressor ACO which is only illustrated partially here. For simplification of the illustration, the rotor blade stages RBS are each reproduced only as a single rotor blade RB, wherein a plurality of rotor blades arranged next to one another along a circumferential direction CD actually produce a rotor blade stage RBS.

A shaft SH of a rotor R of an axial compressor ACO extends along an axis of rotation X. Shown in the respective illustrations, in each case listed in axial sequence are: a rotor blade stage RBS, an interspace with an interspace groove and an interspace cover IC, and a further rotor blade stage RBS. Between the rotor blade stages radially opposite the interspace groove IG, a guide vane stage GVS consisting of guide vanes GV is also reproduced in FIG. 3. The guide vanes GV are formed without a shroud extending in the circumferential direction and located radially in the inside of the guide vanes and are accordingly self-supporting. The rotor blades RB are each connected to the shaft SH in a form-fitting manner in rotor blade grooves RBG. For this purpose, blade roots RBF are introduced into the rotor blade grooves RBG, said blade roots preventing the rotor blades RB from moving radially out of the shaft SH of the rotor R. As reproduced in FIG. 2, the rotor blade roots RBF are designed in the form of a hammerhead and correspond in shape to the rotor blade groove in the shaft SH, and therefore the undercuts of the hammerhead root together with those of the rotor blade groove form a form-fitting connection against axial movement. Alternatively, the blade root can also be designed as a Christmas tree root, or can have a different shape with undercuts. Between the two rotor blade stages RBS, an interspace groove IG is located in the shaft SH, said interspace groove extending in the circumferential direction CD. The rotor blade grooves, wherein one rotor blade groove RBG is provided for each individual rotor blade RB, all open into said interspace groove IG. In this case, a single interspace groove IG is provided for the installation of the rotor blades RB for two rotor blade stages RBS, on both sides of the interspace groove IG. The rotor blades RB are inserted radially with their rotor blade root RBS into the interspace groove IG and are subsequently pushed substantially axially into the rotor blade groove RBG. After all of the rotor blades RB are positioned in their end position in the rotor R or the shaft SH, the interspace cover IC is attached to the shaft SH or the rotor R for covering the interspace groove IG radially to the outside. Alternatively, individual interspace cover segments of the interspace cover IC can also be mounted in the regions in which the rotor blades RB have already been inserted using the interspace groove IG and are accordingly secured in their end position by means of the interspace cover segments ICS against axial displacement. The interspace cover segments ICS close the interspace groove IG in such a manner that a substantially smooth and continuous transition is produced in the axial direction between the upstream rotor blade stage RBS and the interspace groove IG or the interspace cover IC and the downstream rotor blade stage RBS. The interspace cover segments ICS are attached in a form-fitting manner to the shaft SH. At a certain first circumferential position of the interspace groove IC, the shaft SH or interspace groove IG is designed differently than over the rest of the circumference for the purpose of the radial insertion of the interspace cover segments ICS. This point is reproduced schematically in FIG. 1 where an interspace cover segment ICS has a hammerhead root, and said hammerhead root can be inserted in the circumferential direction with a second undercut L2 into a corresponding formation with a first undercut L1 of the interspace groove IG. The interspace groove does not have any first undercut L1 at the first circumferential position, and therefore a radial insertion of the hammerhead root of the interspace cover segments ICS is possible. An alternative to the hammerhead roots of FIG. 1 shows a variant of the invention which is reproduced in FIG. 2, wherein the interspace cover segments ICS have an omega shape and the second undercut L2 extends beyond the axial region of the interspace groove IG. The corresponding first circumferential position is not illustrated in FIG. 2 and, for the purpose of the radial insertion of the interspace cover segments ICS, has to has recesses which extend axially into the region of the rotor blade stages RBS.

FIG. 3 shows a possibility as to how an interspace cover segment ICS can be designed at the first circumferential position as an interspace lock piece ICL and can be fastened to the shaft SH. By omitting the form fit by means of the first undercut L1 and the second undercut L2, as is advantageously provided at the remaining circumferential positions of the interspace groove IG, the interspace lock piece ICSL is secured radially and against movement in the circumferential direction by means of a screw SR. In this manner, all of the interspace cover segments ISC are also secured in a form-fitting manner in the circumferential position. It is possible in principle that all of the interspace cover segments ICS are fastened to the shaft SH against radial movement, even without a further form fit, in a particular development of the invention, additionally or exclusively by means of a screw SR.

The invention claimed is:

1. A rotor of a multi-stage axial compressor, which extends along an axis of rotation, with axial, radial and circumferential directions existing relative to the axis of rotation, the rotor comprising:

a shaft, wherein the shaft has rotor blade grooves, rotor blades, wherein the rotor blades of the rotor which are arranged next to one another in the circumferential direction and are each fastened to a respective rotor blade groove by means of a blade root defining a respective rotor blade stage, wherein at least two rotor blade stages are provided in axial succession, and an interspace groove, extending in the circumferential direction, is provided in the shaft axially between the two rotor blade stages, wherein the rotor blade grooves open into the interspace groove and are designed such that each respective blade root is are insertable radially into the interspace groove and pushed from there into the respective rotor blade groove, and an interspace cover which covers the interspace groove, wherein the interspace cover is designed segmented into interspace cover segments in the circumferential direction, wherein the interspace cover segments are fastened in a form-fitting manner to the shaft, wherein the shaft is an integral component over at least one axial portion of the two rotor blade stages and the interspace groove, and the interspace groove is formed by a turning process performed on the integral component, wherein the interspace groove at least partially has, extending in the circumferential direction, a first undercut which is formed so as to interact in a form-fitting manner in the radial direction with a second undercut of the interspace cover segments in a manner blocking movement of the interspace cover segments in the radial direction.

2. The rotor as claimed in claim 1, wherein the interspace cover covers the interspace groove such that a substantially continuously radial transition is produced in the axial direction of a radially outer surface between the rotor blade stage positioned upstream and the interspace cover, and between the interspace cover and the rotor blade stage positioned downstream.

3. The rotor as claimed in claim 1, wherein the interspace cover is configured to secure the rotor blades against axial displacement in their respective rotor blade groove in an end position.

4. The rotor as claimed at least in claim 1, wherein at least one interspace lock piece is provided for the interspace groove, which interspace lock piece is arranged at a certain first circumferential position of the interspace groove at which at least one of the interspace groove and the interspace lock piece is designed to avoid interaction of the undercuts for allowing radial insertion of the interspace cover segments.

5. The rotor as claimed in claim 4, wherein the interspace groove does not have the first undercut at the certain first circumferential position.

6. The rotor as claimed in claim 1, wherein the interspace cover segments and/or an interspace lock piece are fastened to the shaft by means of at least one screw.

7. An axial compressor comprising:

a rotor as claimed in claim 1.

8. A method for installing a rotor of an axial compressor as claimed in claim 1, the method comprising:

a) providing the shaft, b) inserting the blade roots of the rotor blades radially into the interspace groove, c) pushing the blade roots of the rotor blades axially into the rotor blade grooves, d) installing the interspace cover segments on the shaft in a form-fitting manner to secure the axial position of the blade roots of the rotor blades in the rotor blade grooves.

* * * * *